US008887418B2

(12) United States Patent
Mayer et al.

(10) Patent No.: US 8,887,418 B2
(45) Date of Patent: Nov. 18, 2014

(54) THREE DIMENSIONAL FOAM GREETING CARDS

(75) Inventors: David Mayer, Bay Village, OH (US); Lynne Shlonsky, Shaker Heights, OH (US)

(73) Assignee: American Greetings Corporation, Cleveland, OH (US)

( * ) Notice: Subject to any disclaimer, the term of this patent is extended or adjusted under 35 U.S.C. 154(b) by 0 days.

(21) Appl. No.: 13/568,482

(22) Filed: Aug. 7, 2012

(65) Prior Publication Data

US 2013/0283652 A1 Oct. 31, 2013

Related U.S. Application Data

(63) Continuation-in-part of application No. 13/459,553, filed on Apr. 30, 2012, now abandoned.

(51) Int. Cl.

| | |
|---|---|
| ***G09F 1/00*** | (2006.01) |
| ***B42D 15/02*** | (2006.01) |
| ***G09F 1/08*** | (2006.01) |
| ***B42D 15/00*** | (2006.01) |
| *B42D 15/04* | (2006.01) |

(52) U.S. Cl.

CPC ..... *G09F 1/00* (2013.01); *B42D 15/042* (2013.01); *B42D 15/022* (2013.01); *G09F 1/08* (2013.01); *B42D 15/0093* (2013.01)

USPC ..... 40/124.03

(58) Field of Classification Search

USPC ..... 40/124.01, 124.03

See application file for complete search history.

(56) References Cited

U.S. PATENT DOCUMENTS

| | | | | |
|---|---|---|---|---|
| 2,927,400 | A | 3/1960 | Bailey | |
| 4,299,041 | A * | 11/1981 | Wilson | 40/124.02 |
| 5,641,164 | A * | 6/1997 | Doederlein et al. | 273/237 |
| 5,743,035 | A | 4/1998 | Bradley et al. | |
| 5,841,878 | A * | 11/1998 | Arnold et al. | 381/124 |
| 6,282,819 | B1 * | 9/2001 | Gu | 40/124.03 |
| 6,357,152 | B1 | 3/2002 | Brooks et al. | |
| 6,460,277 | B1 | 10/2002 | Tower | |
| 6,848,965 | B2 | 2/2005 | Wong | |
| 7,201,402 | B2 | 4/2007 | Duprey | |
| 7,416,467 | B2 * | 8/2008 | Avdellas | 446/297 |
| 7,634,864 | B2 | 12/2009 | Segan | |
| 2007/0153638 | A1 * | 7/2007 | Lebbing | 368/274 |
| 2008/0032587 | A1 | 2/2008 | Krivanek et al. | |
| 2008/0289230 | A1 * | 11/2008 | Mandelbaum et al. | 40/124.01 |

(Continued)

FOREIGN PATENT DOCUMENTS

| | | |
|---|---|---|
| NL | 1033961 | 12/2007 |

*Primary Examiner* — Gary Hoge

(74) *Attorney, Agent, or Firm* — Christine Flanagan

(57) ABSTRACT

Three-dimensional lightweight foam greeting cards are described herein having a foam body with a perimeter wall that extends between two spaced apart parallel pieces of planar sheet material such as heavy gauge paper, cardboard, or other such material. The greeting cards have a partially hollowed foam body or one or more cavities in the foam body concealed in the front and back by the planar sheet material which may be pre-cut in the shape of the foam body are decorated consistent with the design of the foam body. The cavities in the foam body may contain various electronic components that enable the greeting card to produce sound and/or other special effects. The greeting cards may include various switch mechanisms that may be located and accessed through various locations on the foam greeting card body.

19 Claims, 8 Drawing Sheets

(56) References Cited

U.S. PATENT DOCUMENTS

| | | | | |
|---|---|---|---|---|
| 2009/0126239 | A1 | 5/2009 | Clegg | |
| 2009/0241387 | A1 | 10/2009 | Wong | |
| 2010/0052934 | A1* | 3/2010 | Clegg et al. | 340/815.4 |
| 2010/0296010 | A1* | 11/2010 | Finnegan | 348/794 |
| 2012/0110879 | A1* | 5/2012 | Qiao et al. | 40/124.03 |

* cited by examiner

THREE DIMENSIONAL FOAM GREETING CARDS

RELATED APPLICATIONS

This application is a continuation-in-part of and claims priority to U.S. patent application Ser. No. 13/459,553, filed on Apr. 30, 2012, now abandoned which claims priority to U.S. patent application Ser. No. 13/004,544, filed on Jan. 11, 2011 (now U.S. Pat. No. 8,205,365). All of the above-mentioned applications are incorporated herein by reference in their entirety.

FIELD OF THE INVENTION

The present invention relates to greeting cards, and more specifically to three-dimensional foam greeting cards and decorative greeting card accessories.

BACKGROUND OF THE INVENTION

For many years paper greeting cards have been widely used for celebratory occasions such as birthdays, graduations, weddings and other commercial purposes. Traditional text information is generally found on paper greeting cards. More recently, sound has been added to traditional paper greeting cards to increase the personalization of the cards by delivering an audio message that is electronically embodied in circuitry that is carried within the greeting card. The ability to use sound in combination with printed matter such as with conventional printed greeting cards significantly enhances the communicative value of social and relational greetings. The availability of small voice recording sound modules has made sound-generating greeting cards increasingly popular. Small lighting systems have also been incorporated into social greeting products and novelties, and combined in circuits with sound and other features.

SUMMARY OF THE INVENTION

A three-dimensional foam greeting card is described herein, in one embodiment, having a three-dimensional foam body, a first planar surface material attached to a front surface of the three-dimensional foam body, a second planar surface material attached to a back surface of the three-dimensional foam body and a sound module located in a recess in the three-dimensional foam body and concealed by the first and second planar surface material. The sound module may include a speaker, circuit board, integrated circuit, microprocessor, memory device, power source, at least one switch mechanism and at least one pre-loaded digital audio file. The at least one switch mechanism controls playback of the at least one pre-loaded digital audio file.

In another embodiment, the three-dimensional foam greeting card of the present invention contains a three-dimensional foam body having at least one hollowed out portion creating a cavity therein, a first planar surface attached to a front surface of the three-dimensional foam body, a second planar surface attached to a back surface of the three-dimensional foam body, a sound module comprising a speaker, circuit board, integrated circuit, microprocessor, power source, memory device and at least one pre-loaded audio file, a recording device, a first switch to initiate a user recording session, and a second switch to initiate playback of the at least one pre-loaded audio file or a user recorded message.

In still another embodiment, the foam greeting card contains a three-dimensional foam body with a perimeter wall which extends between two spaced apart parallel pieces of heavy gauge planar sheet material, and a multimedia player device located and concealed within the three-dimensional foam body. The multimedia player device may include a circuit board, integrated circuit, microprocessor, speaker, power source, memory device, an electronic display screen operative to display digitally generated images, a data storage device, at least one switch mechanism, and at least one pre-loaded digital audio or video file. The electronic display screen is visible through an opening in the three-dimensional foam body and one of the pieces of heavy gauge planar sheet material.

DETAILED DESCRIPTION OF PREFERRED AND ALTERNATE EMBODIMENTS

The present disclosure and related inventions provide foam constructs in the form of greeting devices, greeting cards, novelties, gifts and foam constructs with functional features, and which can be used in connection with other devices such as retail displays.

Figure 3:
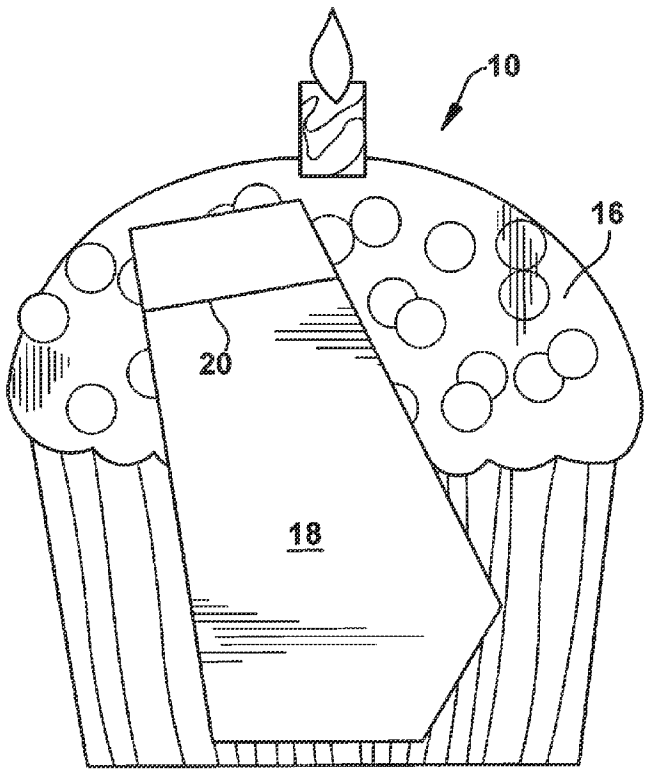
FIG. 3 is a rear view of the three-dimensional foam greeting card of FIG. 1.
Figure 2:
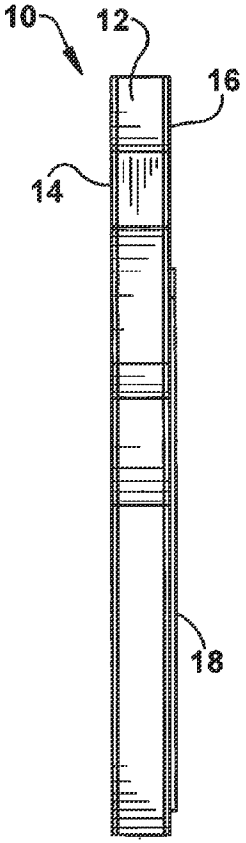
FIG. 2 is a side view of the three-dimensional foam greeting card of FIG. 1.
Figure 9:
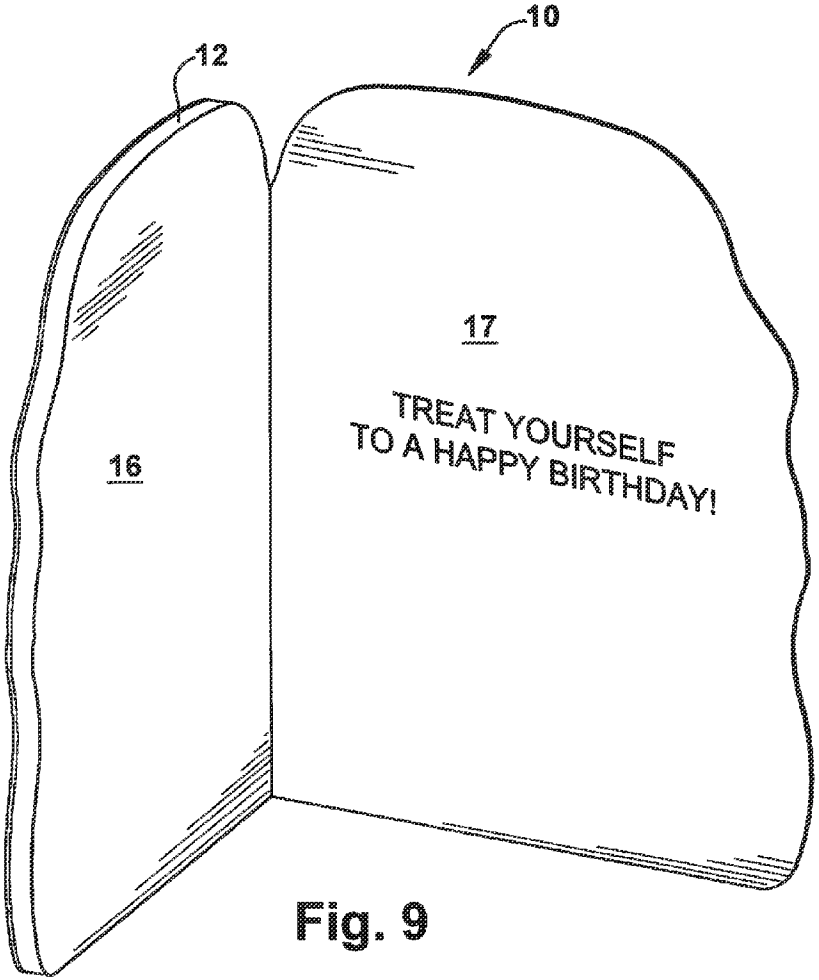
FIG. 9 is a perspective view of the three-dimensional foam greeting card of FIG. 8 in an open position.
Figure 8:
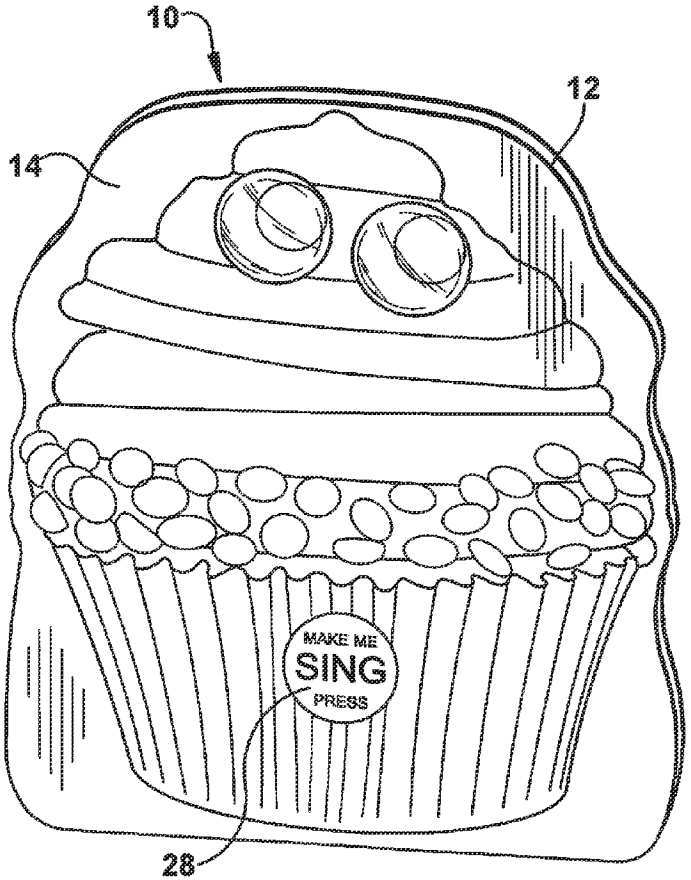
FIG. 8 is a front view of an alternate embodiment of the three-dimensional foam greeting card of the present invention in a closed position.

In one form, a three-dimensional foam greeting card according to the present invention contains a foam body made of a hardened foam or foam-like material which makes the greeting card very lightweight. A representative example is shown in FIGS. 1-4. The foam body 12 of the greeting card 10 can be formed into any shape or profile, examples of which include, but are not limited to: a circle, a cupcake, a candle, an animal, a person, a baby carriage, a Christmas tree, a pumpkin, or any other conceivable shape. Or the greeting card 10 may take on a square or rectangular shape of a traditional greeting card. A portion of the foam 12 is hollowed out to accommodate a device, examples of which include, but are not limited to: a sound module (shown in FIG. 4), a light module, a motor module, a multimedia player device or any combination thereof. There may be multiple cavities formed in the foam body 12 to receive multiple devices or device components such as batteries, switches, circuit boards, speakers, motors, recording devices, etc. The front and back surfaces of the foam body 12 are generally planar and can be covered with a heavy gauge paper-like material such as paper, cardboard, cardstock, or any other sheet or planar material. The outer paper-like surface 14, 16 can be cut in the shape of the foam body 12 and pre-printed with a design consistent with the shape of the foam body 12. The front surface 14 may bear decoration consistent with a front view of the item and the back surface 16 may contain decoration consistent with the back view of the item. For example, if the foam body and outer cover contain the shape and decoration of a dog, the front cover of the foam greeting card may contain the right side profile of the dog and the back cover may contain the left side profile of the dog. The outer surfaces 14, 16 are adhesively or otherwise attached to the foam body 12. The greeting card 10 may contain, in addition to the three-dimensional foam body 12 with planar front 14 and back 16 surfaces, a sentiment panel 17, which may be connected to the planar sheet material located on either the front 14 or back 16 surface of the foam body 12. This configuration is shown in FIGS. 8 and 9. The sentiment panel 17 may be, as shown, shaped in the same way as the foam body 12 and corresponding front 14 and back 16 sheet materials. If the sentiment panel 17 is connected along a fold line to the planar sheet material located on the front surface 14 of the foam body 12, it would serve as an outside front cover and an inside left panel of the greeting card 10. In a closed position, the sentiment panel 17 would be folded over the front surface 14 of the foam body 12 revealing only the outer surface of the sentiment panel 17. In an open position, it would be folded away from and revealing the front surface 14 of the greeting card 10 and the inner surface of the sentiment panel 17. Text sentiment and/or printed photographs or graphics may be contained on both the inside and outside surface of the sentiment panel. If the sentiment panel is connected along a fold line to the planar sheet material located on the back surface 16 of the foam body 12, as is shown in FIG. 9, it would serve as an outside back cover of the greeting card 10 and an inside right panel of the greeting card 10. In a closed position, the sentiment panel 17 would be folded over the back surface 16 of the greeting card 10. In an open position, it would be folded away from the back surface 16 of the greeting card 10 revealing the back surface 16 of the greeting card 10 and the inner surface of the sentiment panel 17. The three-dimensional greeting card 10 may additionally contain a display arm 18 attached to the back surface 16 of the greeting card 10, as shown in FIG. 3. The display arm 18 may be made out of cardboard or other rigid material. The upper portion of the display arm 18 is creased along a fold line 20 so that the display arm 18 may bend outward to function as a support for the greeting card 10, allowing the greeting card 10 to be displayed in a standing position.

Figure 4:
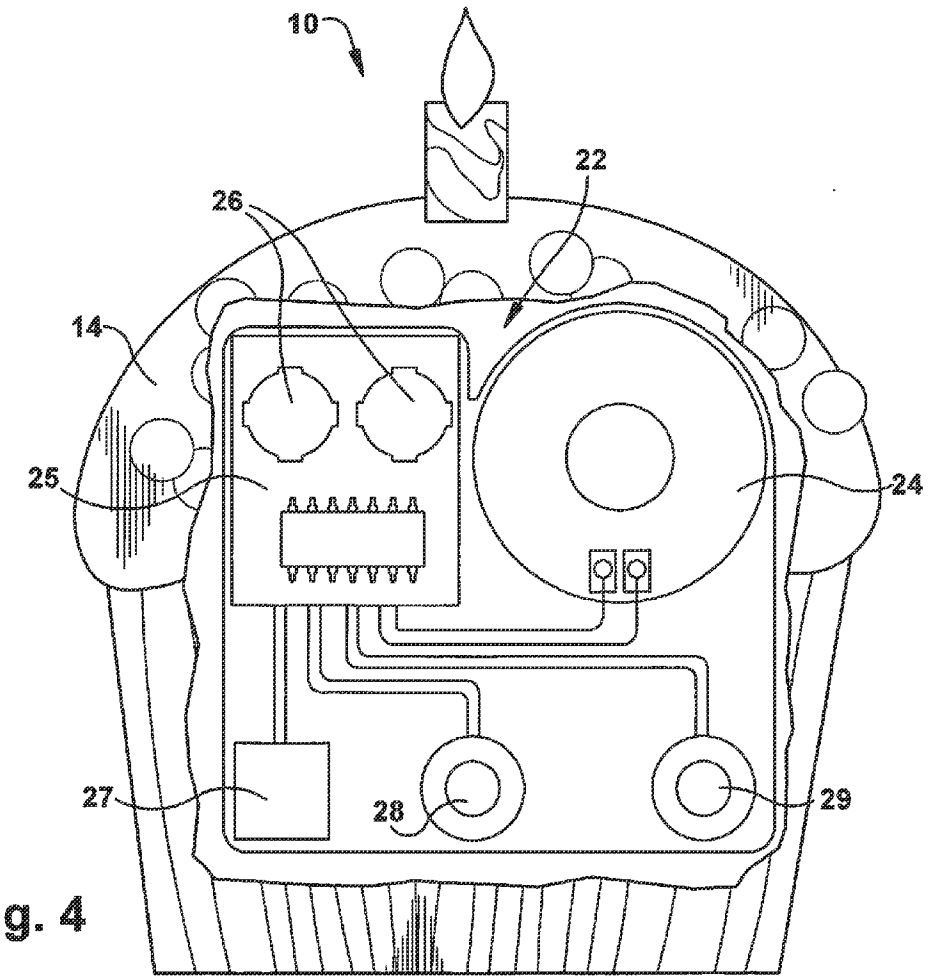
FIG. 4 is a front internal view of the three-dimensional foam greeting card of FIG. 1.

In another embodiment, the foam greeting card, as described above, may contain a sound module 22, as shown in FIG. 4. Components of the sound module may include a circuit board 25, an integrated circuit, a microprocessor, a speaker 24, a memory module, a power source 26, a switch 28, and any other components necessary to trigger and playback a pre-recorded digital audio file. The digital audio file may contain music, singing, a voice message, or any other recordable sound. Components of the sound module 22 may be contained and concealed within a hollowed out portion of the foam body 12. The switch 28 which triggers playback of the audio file may be an electro-mechanical push-button switch 28. This type of switch may be implemented as a press-button 28, wherein each time a user presses the button, playback of the audio file is initiated. A sticker or printed label may be placed above the press-button switch on the outer surface 14 of the greeting card 10 to indicate that this is the area the user must press to playback the audio file. The sticker or printed label may simply say "play" or "press here". Alternatively the surface of the greeting card 10 above the press-button may be printed with words and/or indicators to designate the location of the push-button 28. The switch may alternatively be a mechanical on/off switch which may be located on the front or back surface of the foam greeting card or it may also be located along the perimeter of the foam body 12. A slide trigger switch may also be used to initiate playback of the pre-recorded digital audio file. This type of switch may be particularly used with a foam greeting card having a sentiment panel, as described above, attached to the front or back surface of the greeting card. A slide switch mechanism may be placed over a fold line between the sentiment panel and the foam body such that when the greeting card is opened by moving the sentiment panel away from the foam body, the slide trigger activates the pre-recorded audio. Other switch mechanisms may be used such as light sensitive switches, motion sensitive switches, touch sensitive switches, pressure sensitive switches, thermal switches, moisture or capacitive switches or any other switch which would be known to one skilled in the art.

Figure 1:
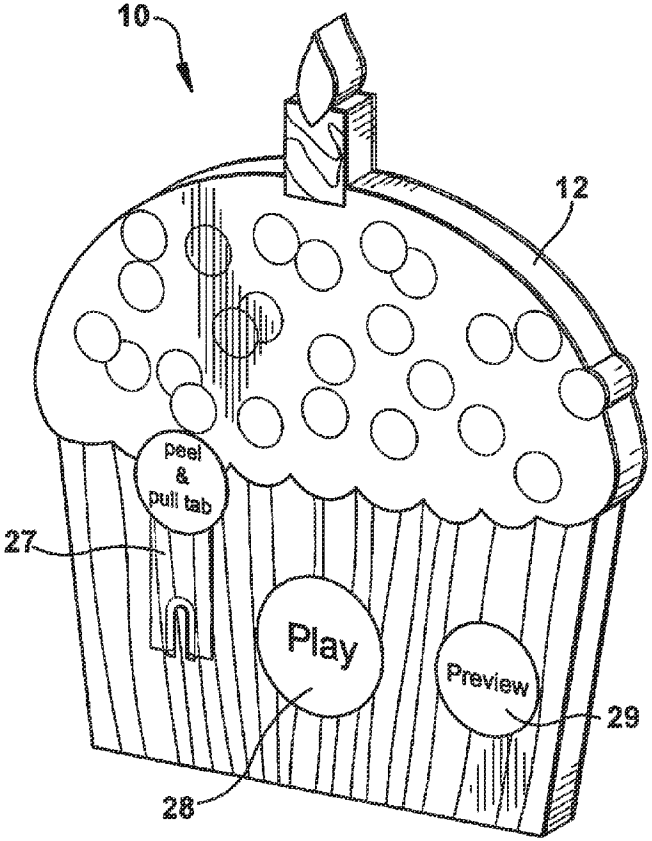
FIG. 1 is a perspective view of a first embodiment of the three-dimensional foam greeting card of the present invention.

In another embodiment, the three-dimensional foam greeting card, as described above, contains both a sound and recording module that provide the user with the ability to record a personalized message to the card recipient. As shown in FIGS. 1 and 4, this embodiment may include at least two electro-mechanical switches 28, 29 to initiate a recording session and a playback session and a microphone. A first switch 28 or "play" button, which may be implemented as a push-button switch as described above, may in a first mode initiate playback of a pre-recorded message instructing the user how to record a personal message and in a second mode initiate playback of the user's personal message. A second switch 29, or "preview" button, which may also be implemented as a push-button, may initiate a recording session wherein the user may record a personal message to the greeting card recipient. A third switch 27 or pull tab is located on the outer surface of the greeting card. This third switch 27 controls whether the greeting card 10 is in a first mode, wherein a user can test the card functionality by recording and previewing the recorded message without the ability to play the message a second time or to hear the message upon pressing the "play" button, or a second mode, wherein the user has purchased the greeting card, and removed the pull tab 27 thereby permitting the user to record a message which is then saved within the sound module and is thereby available for playback upon pressing the "play" button 28. The third switch or pull tab 27 may be located on the outer surface of the greeting card 10 so that is visible to the purchaser. While the pull tab 27 is still intact, pressing the "play" button will initiate playback of a pre-recorded voice message instructing the user how to record a personal message. Once the pull tab 27 has been removed, pressing the "play" button 28 will initiate playback of the user-recorded message. Pressing the "preview" button 29 initiates a recording session, regardless of whether the pull tab 27 has been removed or not. The recording session will continue as long as the user continues pressing or holding down the "preview" button 29 or until the amount of storage allotted for the user-recorded message has been exhausted. Once the user has finished recording the personal message, the personal message will automatically be played back. In the first mode, when the pull tab 27 is still intact, the user-recorded message is played back once and discarded, disabling further playback of the user-recorded message. In the second mode, once the pull tab 27 has been removed, the user-recorded message is immediately played back and saved so that it can be re-played by pressing the "play" button 28. The user may record over a previous message simply by pressing the "preview" button 29 and recording a new message which will overwrite the previously saved user-recorded message. The "preview" button 29 may be indicated on the outer surface of the greeting card by a removable sticker or label. Once the user purchases the greeting card and has recorded a satisfactory message, he/she can remove the "preview" sticker or label before sending the greeting card to the recipient.

Figure 6:
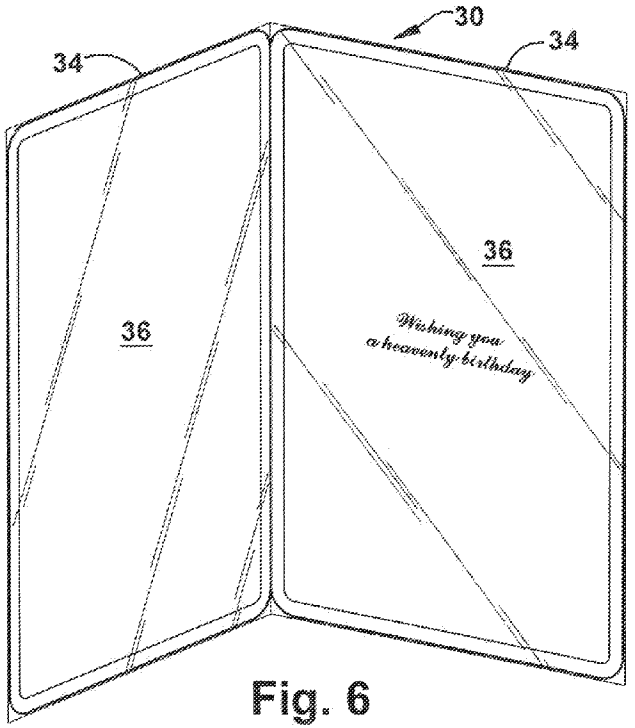
FIG. 6 is a perspective view of the three-dimensional foam greeting card of FIG. 5 in an open position.
Figure 7:
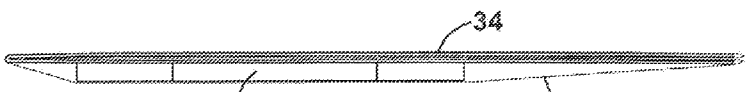
FIG. 7 is a top view of the three-dimensional foam greeting card of FIG. 5 in the direction of arrows 7-7.
Figure 5:
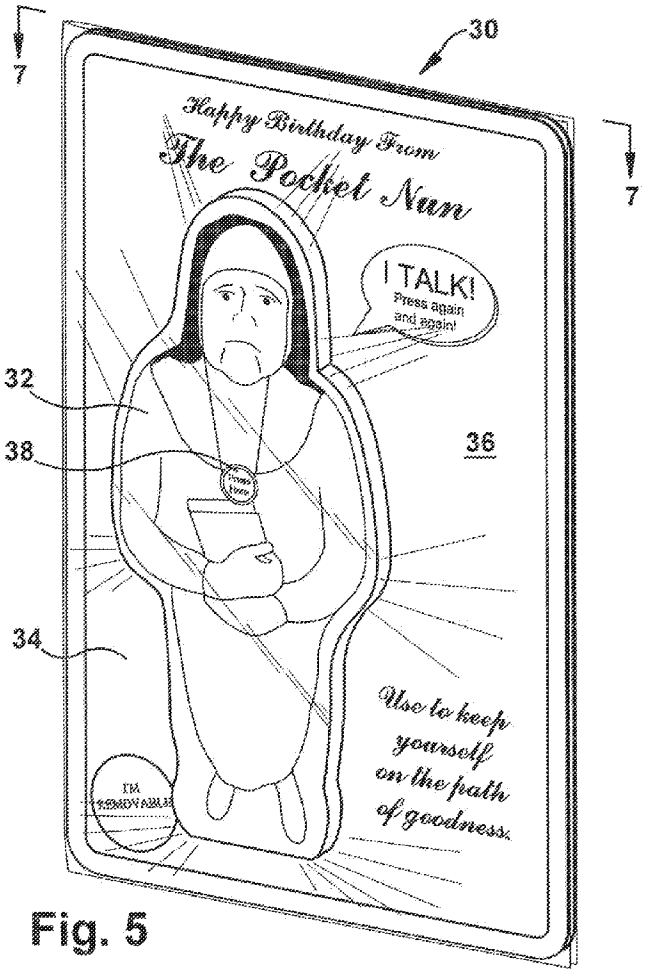
FIG. 5 is a perspective view of an alternate embodiment of the three-dimensional foam greeting card of the present invention in a closed position.

In another form, the three-dimensional foam greeting card of the present invention may be paired with a traditional paper greeting card, such as is shown in FIGS. 5-7. In this embodiment, the removable foam greeting card 32 may serve as a keepsake or token once the paper greeting 34 has been discarded. As shown in FIGS. 5-7, a sealed clear or transparent sleeve 36 made of plastic or other such material is used to pair the separate foam structure 32 and paper greeting card 34 in the same package. The foam structure 32 may be inserted into the sleeve 36 in front of the paper greeting card 34 so it is visible when looking at the greeting card 30 on a greeting card display. Alternatively, the foam structure 32 may be placed on the inside of the paper greeting card 34 to be discovered by the card recipient upon opening the greeting card 30. The foam structure 32 may contain sound, recording, light, motor, multimedia module, or combinations thereof as described in further detail below. As shown in the representative embodiment, the removable foam structure 32 contains a press button 38 which controls activation of an internal sound module, similar to the sound module shown in FIG. 4. Depression of the press button 38 may initiate playback of a pre-loaded audio file containing a voice message, music, sound, or any other digital recording.

Figure 11:
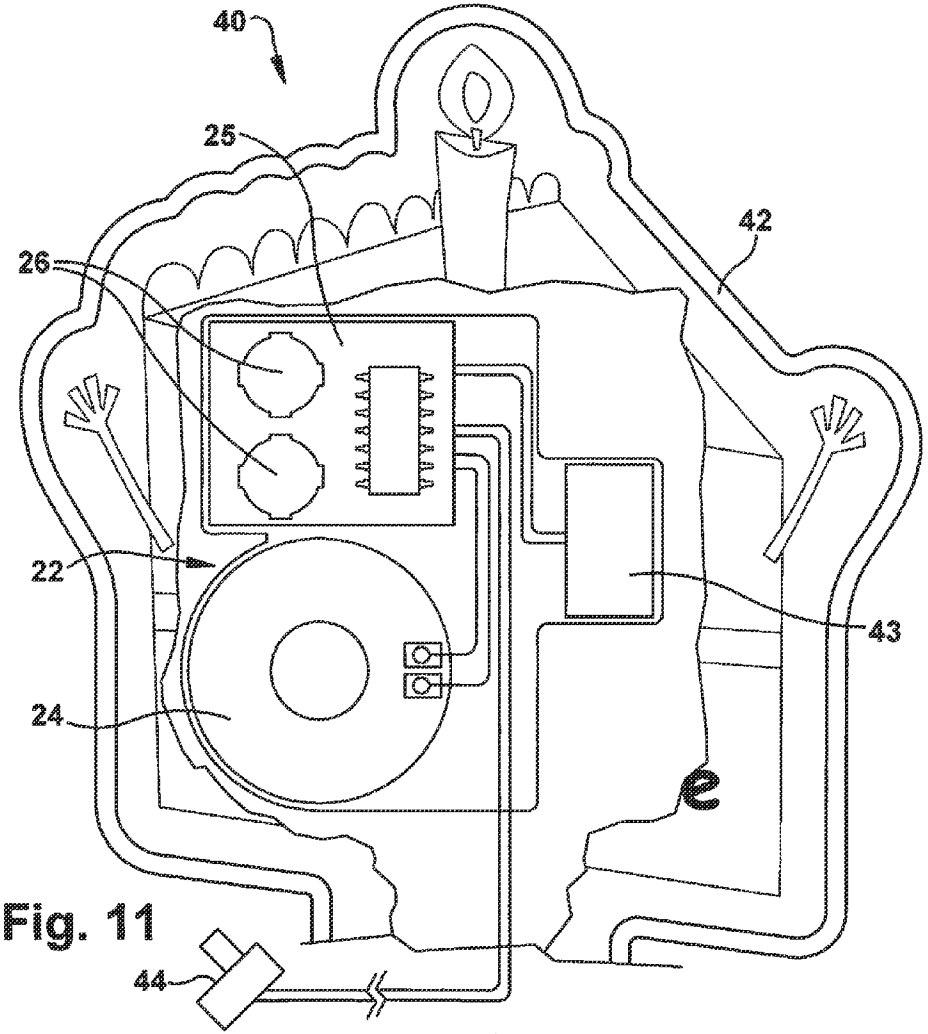
FIG. 11 is an internal view of a portion of the three-dimensional foam greeting card of FIG. 10.
Figure 10:
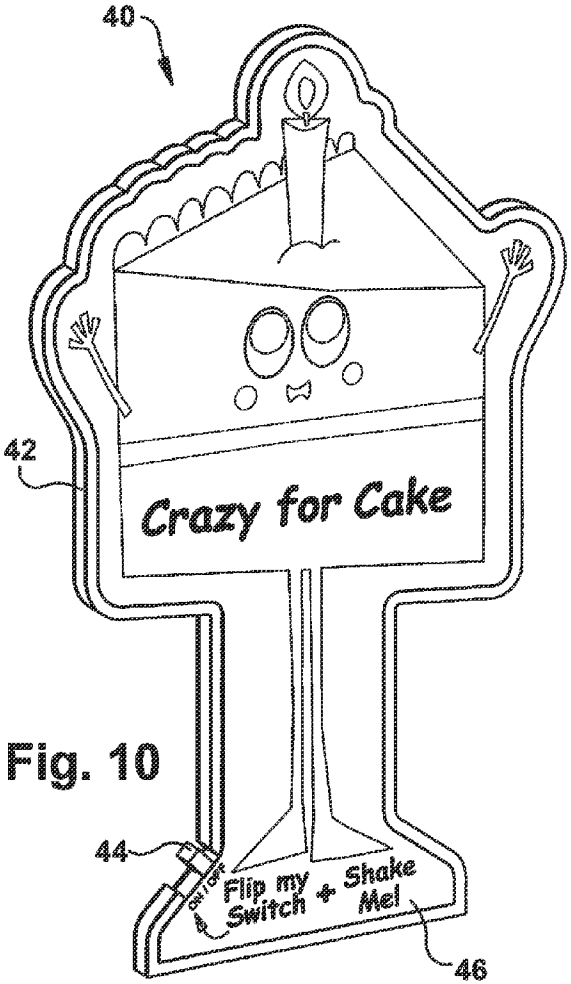
FIG. 10 is a perspective view of an alternate embodiment of the three-dimensional foam greeting card of the present invention.

The three-dimensional foam greeting card with sound, as described above, can additionally contain a motion sensor which operates to trigger one or more pre-loaded audio files. A representative example is shown in FIGS. 10-11. In this embodiment, in additional to the sound module 22 as described above, contains a motion sensor 43 within the cavity in the foam body 42. The motion sensor 43 can be used, in one embodiment, to trigger playback of a first pre-loaded audio file. In another embodiment, a first pre-loaded audio file may be played upon activating a first switch such as a push button switch or toggling a mechanical on/off button 44, as shown in FIGS. 10-11. After the first pre-loaded audio file is played back, movement of the foam body 42 activates the motion sensor 43, which triggers a second pre-loaded audio file. For example, the greeting card 40 may contain instructions to "shake me" 46 so that when the user begins to shake the foam body 42, the motion sensor 43 triggers playback of a pre-loaded audio file.

In another embodiment, the three-dimensional foam greeting card of the present invention may contain a light module with integrated LED lights. The light module would contain A light strand may be stored within a hollowed out portion of the greeting card body between the front and back surfaces of the card. The lights may be programmed to strobe in sequence or blink randomly. Different light colorations may be used as well. Other types of lighting, such as ribbon LED lights may also be used. An electro-mechanical push-activated switch may be used to allow the user to control whether the lights are turned on or off. Also, the lights may be used in combination with pre-recorded sound or a user-recorded message. A single switch may initiate playback of a pre-recorded or user-recorded message as well as turning the lights on or the audio playback and lights may be controlled by different switches.

In yet another embodiment, the three-dimensional foam greeting card of the present invention may contain a motor module located in the hollowed cavity in the foam located between the front and back panels of the greeting card. The motor module causes movement of at least one mobile object associated with the greeting card. The movement may be up and down motion, side to side lateral motion, or any other reciprocating motion. The motor module may contain a rotating gear mechanism that when activated turns a circular gear which is attached at one end to the mobile object. The mobile object can be any three dimensional object which extends outward from the front surface of the greeting card body. Activation of the motor module, which can be by a push button switch, slide switch, or any other switching mechanism, causes movement of the mobile object. Other novelties may be attached to the outside surface of the foam body such as moving eyes or other decorative embellishments.

Figure 13:
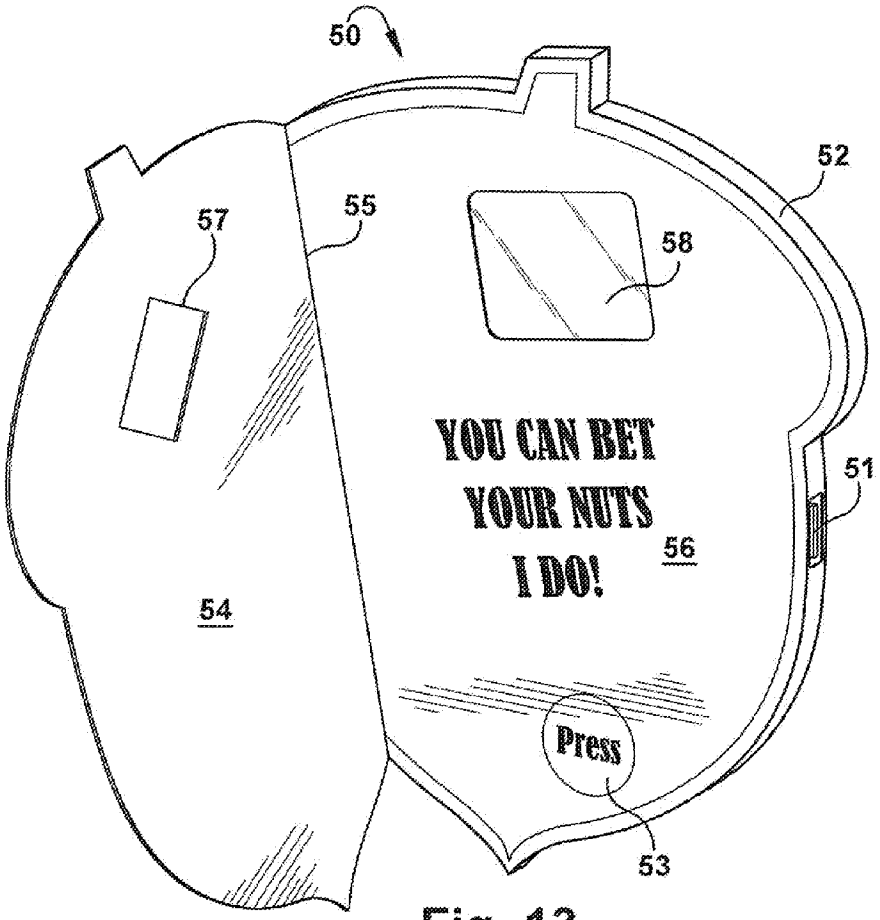
FIG. 13 is a perspective inside view of the three-dimensional foam greeting card of FIG. 12 in an open position.
Figure 12:
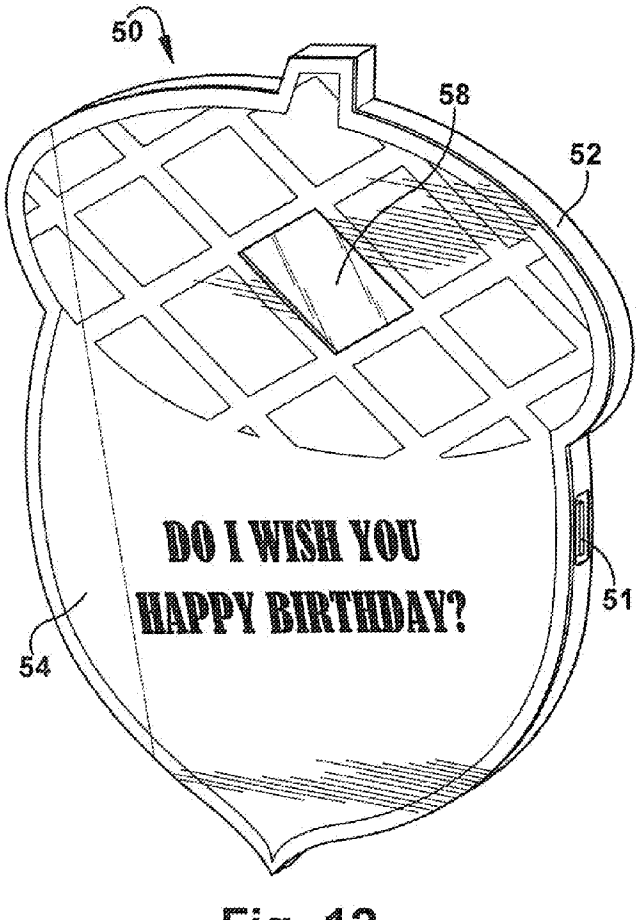
FIG. 12 is a perspective view of an alternate embodiment of the three-dimensional foam greeting card of the present invention in a closed position.

In still another embodiment, the three-dimensional foam greeting card of the present invention may be operative to play pre-loaded video and/or audio recordings. In this embodiment, a representative example of which is shown in FIGS. 12 and 13, a multimedia player device is contained within the hollowed cavity in the foam body 52 located between the front and back panels of the greeting card 50. The multimedia player device may be capable of displaying pre-loaded images or video and emitting sound. Components of such multimedia player device may include, but are not limited to, a flat panel display screen 58, such as an LCD screen, a power source which preferably consists of one or more disposable batteries, an audio speaker, integrated circuit, a circuit board with microprocessor, a data storage device and related circuitry. The device may contain at least one pre-recorded slideshow with accompanying pre-recorded digital audio files. A representative device may store up to approximately 20 pre-loaded photos or images and between approximately 26 seconds to 2.26 minutes of audio or greater, depending on the amount of digital storage provided. The device, when powered by four disposable lithium batteries, is capable of playing the pre-loaded audio/visual content approximately 300 times. Representative width and/or height dimensions of a display screen 58 are between approximately 1.5 and 2.4 inches. The screen 58 may be visible through an opening in the planar sheet material located on the front surface 56 of the foam body 52. The foam greeting card body 52 may additionally contain a sentiment panel 54, as described above, which is attached along a fold line 55 to the planar sheet material attached to the front surface 56 of the foam body 52. The sentiment panel 54 would serve as the front cover of the greeting card 50 and in a closed position, lay atop the sheet material attached to the front surface 56 of the foam body 52. The sentiment panel 54 may also contain an opening thereon 57, consistent with the opening for the display screen 58 contained on the planar sheet material located on the front surface 56 of the foam body 52, through which the display screen 58, contained within the foam body 52, is visible. The multimedia display device may be activated by a push button switch 53 located on the front or back surface of the foam body 52. The greeting card 50 may contain the words "play" printed above the push button switch 53 which indicates where the multimedia player device is activated. Alternatively, the greeting card 50 may contain a slide switch which is used in combination with a sentiment panel 57, as described above. The slide switch may be located across a fold line 55 between the sentiment panel 54 and the foam greeting card body 52, such that when the greeting card 50 is opened or the sentiment panel 54 is folded away from the greeting card body 52, the slide switch works to activate the multimedia player. The greeting card 50 may additionally contain a mechanical on/off switch or button which controls whether or not the multimedia player device may be activated. The on/off switch may be located along the side perimeter of the foam body 52 between the planar sheet material located on the front and back surfaces of the foam body or it may be located on the front or back surface of the greeting card body.

A further embodiment of the three dimensional foam greeting card with multimedia player device, as described directly above, may contain audio recording capabilities which would provide a user with the ability to record a personalized message to be played before, during or after the pre-recorded slideshow is displayed on the display screen. Additional components such as a sound and recording module, as described above with reference to a previous embodiment, would accompany the multimedia player device within the cavity located within the foam body between the front and back panels of the greeting card. The multimedia player device may contain one or more pre-recorded audio files that may be played before during or after the personalized user recorded message.

Further still, the three dimensional foam greeting card with multimedia player device may additionally include a USB port 51, SD slot or any other appropriate external memory input source so that a user may upload digital video, digital photos and/or digital audio files to be presented on activation of the multimedia device. The multimedia device may be capable of playing several file formats including, but not limited to, flash, html, html5, mp3, mp4, .mov, .rp4, /wma, etc. The multimedia player device may also contain one or more pre-loaded digital video, photo and/or audio files which may be played in combination with the user uploaded digital video, photo and/or audio. The video, slideshow and/or audio may be triggered by any of the switch mechanisms described herein and playback may further be controlled by a mechanical on/off switch. The switch mechanisms may be located on the front or back of the greeting card or along the side perimeter of the foam structure.

Still another embodiment of the present invention is shown in FIGS. 14-17. This embodiment includes a foam greeting card body 62 with electronics module including a motion sensor, such as a ball sensor 70 and on/off switch 64 operative to playback audio each time the greeting card 60 is turned in a clockwise or counter-clockwise motion.

Figure 15:
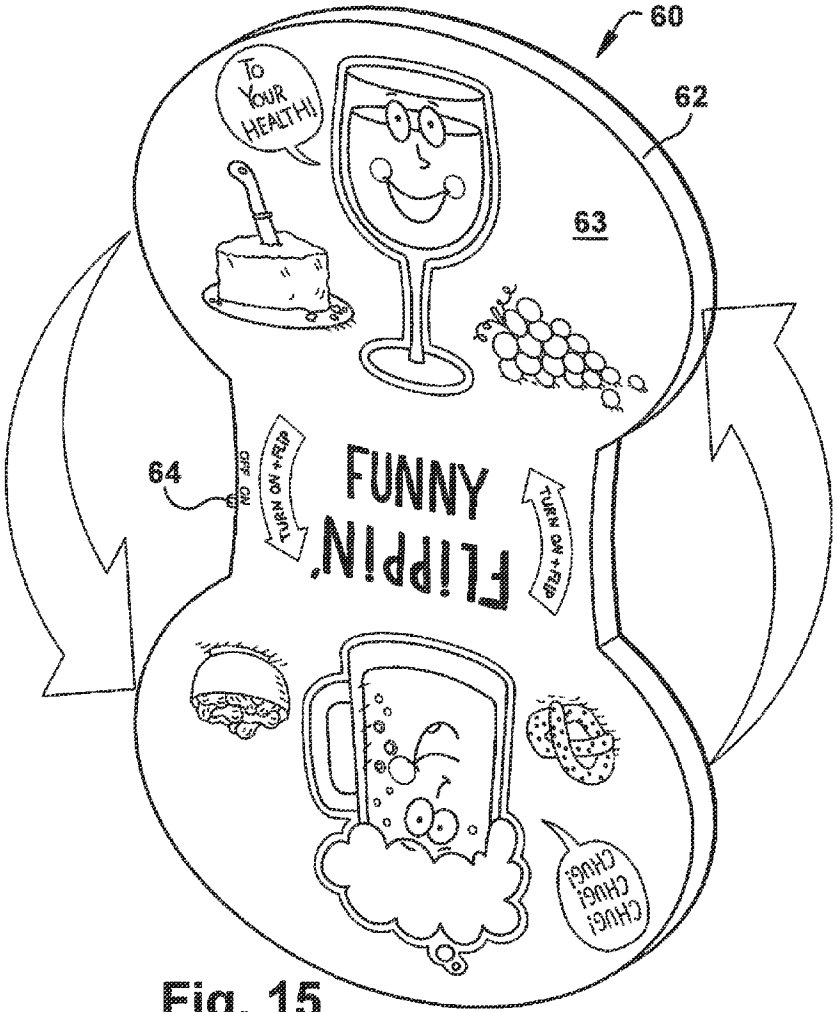
FIG. 15 is a perspective view of the three-dimensional foam greeting card of FIG. 14 in a reverse or upside-down position.
Figure 14:
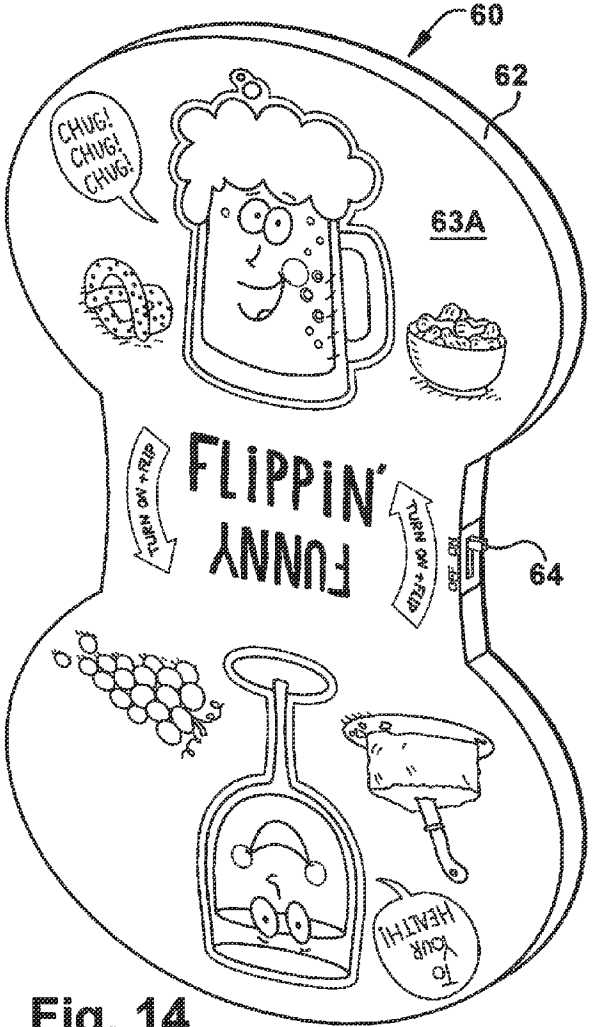
FIG. 14 is a front perspective view of an alternate embodiment of the three-dimensional foam greeting card of the present invention.
Figure 17:
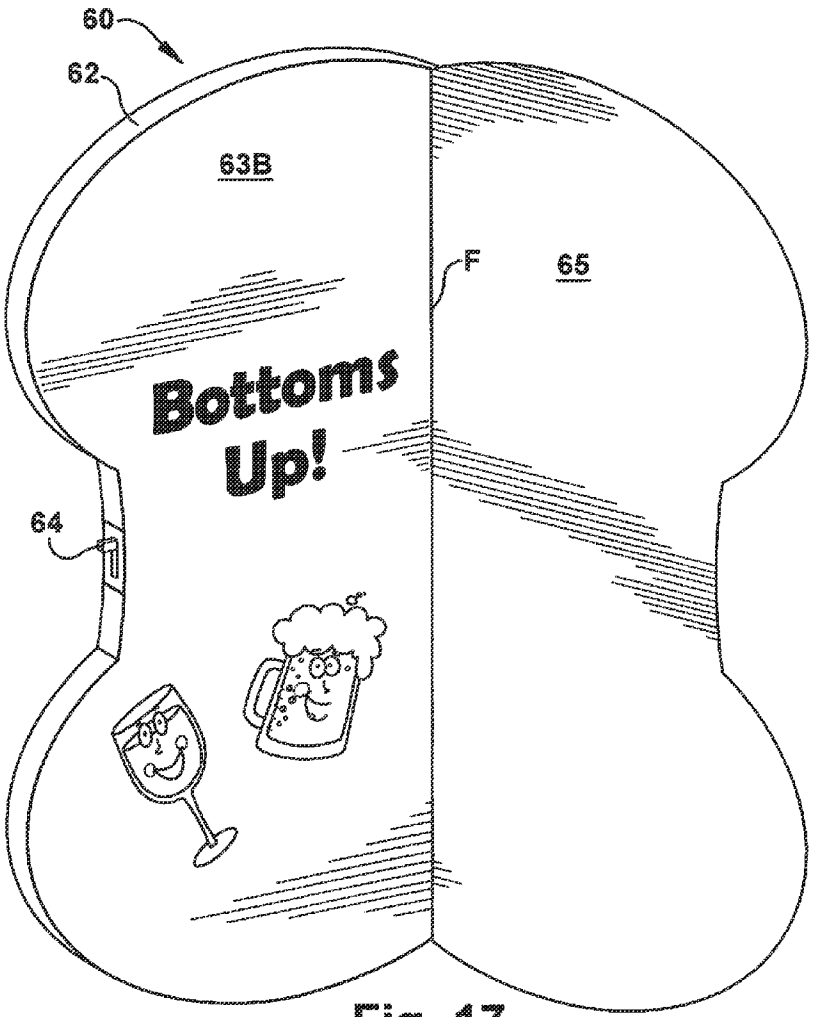
FIG. 17 is a rear perspective view of the three-dimensional foam greeting card of FIG. 14, in an open position.
Figure 16:
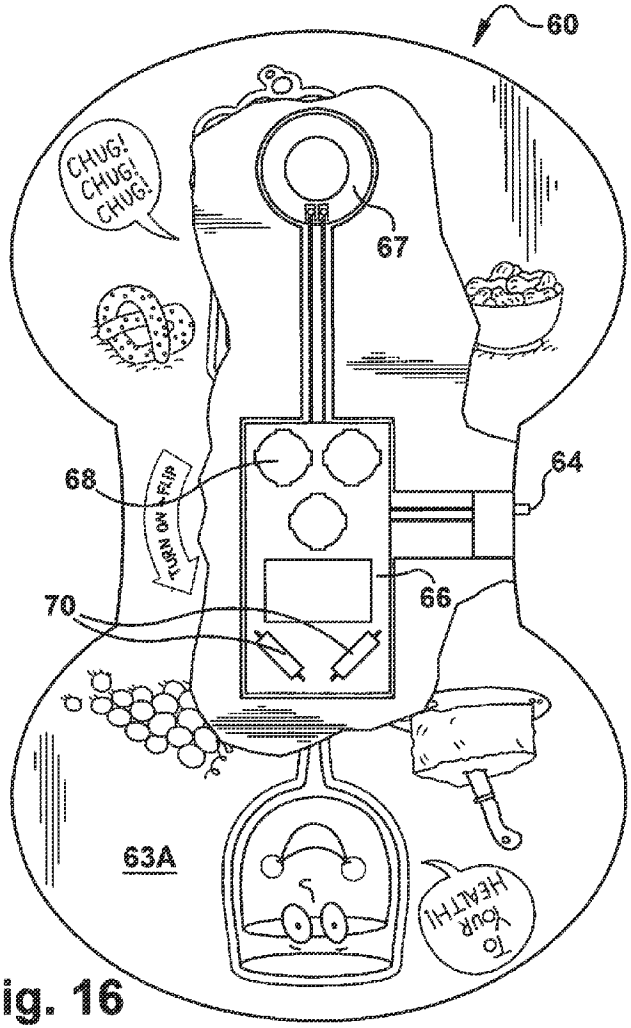
FIG. 16 is a front tear away view of the three-dimensional foam greeting card of FIG. 14.

The foam greeting card 62 body consists preferably of one single piece of foam having one or more cavities located therein, although the body may consist of more than one distinct foam piece. The foam 62 may be shaped in any linear or non-linear form. For example, the greeting card 60 shown in the figures is of a shape resembling a dog bone having two opposing ends with semi-circular outer edges with a straight, linear portion therebetween. The foam body 62 has a front surface, a back surface opposite the front surface and a perimeter surface which extends between the outer edges of the front and back surfaces. Preferably, the front, back and perimeter surfaces of the foam are substantially planar. A cover or sheet material 63A, 63B may be attached to the front and back surfaces of the foam body. This cover or sheet material 63A, 63B may be made of paperboard, cardboard or other such relatively thin but rigid material and may have various drawings, photos, text or any other artwork printed thereon. The front cover material 63A may also contain written instructions for operating the greeting card. In a preferred embodiment, as shown in FIGS. 14 and 15, the front cover material 63A contains the phrase "turn on+flip" printed within opposing arrows on opposing sides of the material 63A to direct the user to turn on the card 60 and then "flip" the greeting card 60 in a clockwise or counterclockwise direction. The cover material 63A, 63B serves as a substrate for the printed materials but also to conceal the electronics or other components contained within the cavity or cavities contained within the foam body 62. The cover or sheet material 63A, 63B is preferably shaped in the form of the foam body 62. The perimeter surface is preferably left uncovered by the sheet material 63A, 63B but can also be covered as well. The front 63A or back 63B cover material may also contain an additional sheet or panel, referred to herein as a sentiment panel 65, which is connected to the front 63A or back 63B cover material along a fold line F. The sentiment panel 65 is a mirror image or partial mirror image of the front 63A or back 63B cover material and is folded along the fold line F to lie directly atop the front 63A or back 63B cover material to which it is attached. It serves as a greeting card panel that can be opened and closed to reveal written sentiment or other artwork contained between the two panels. Preferably, the sentiment panel 65 is attached to the back cover material 63B, as shown in FIG. 17, but may also be attached to the front cover material. The front 63A or back 63B sheet material may also contain three-dimensional embellishments including, but not limited to moving eyes, die cut shapes connected via a spring so that bouncing or other movement is effectuated similar to a bobble head figure, or any other embellishment or adornment that may enhance the entertainment value of the greeting card.

An electronics module is contained in the one or more cavities contained within the foam body 62 and is concealed by the front 63A and/or back 63B cover material. The electronics module may contain a circuit board 66, an integrated circuit chip, a memory device having one or more pre-recorded audio files saved thereon, a speaker 67, a power source 68, one or more sensors and/or switches and any other electronic or non-electronic component which facilitates storing and replaying audio files upon movement of the greeting card 60. The electronics module may also contain other components which facilitate other special effects such as lighting or mechanical movement. In a preferred embodiment, and as shown in the figures, the electronics module includes an on/off switch 64 which contains a lever or other control which is accessed through the perimeter of the foam body 62. The on/off switch may alternatively be a press button accessed through the front or other surface of the greeting card, or any other type of toggle or power switch. The electronics module also includes a motion sensitive switch or sensor such as a ball sensor or rolling ball sensor, also referred to as a "tilt switch" 70. The ball sensor 70 contains a cavity of some sort, such as a cylindrical cavity, and a conductive free mass inside the cavity, such as a rolling ball. One end of the cavity has two conductive elements or poles. When the sensor 70 is oriented so that the end is downwards, the mass rolls into the poles and shorts them which, in effect throws the switch. While the preferred embodiment has been described as having a ball sensor or tilt switch 70, any type of motion sensitive switch or sensor may be used.

In operation, a user moves the on/off switch 64 into the "on" position and playback of a first audio clip or segment is initiated. Thereafter, rotating or moving the greeting card 60 in a clockwise or counterclockwise direction moves the ball to the opposite end of the sensor 70, thereby triggering playback of a second audio clip. This procedure may continue while the greeting card 60 remains in the "on" position. Playback of a different audio clip is initiated upon each turn or rotation of the greeting card 60, until a complete sequence of the audio clips has been played back. Thereafter, the sequence of audio clips is repeated. In a preferred embodiment, the audio clips are replayed in a specific sequence, however, in another embodiment the various audio clips may be replayed randomly. For example, in the greeting card 60 shown in the FIGS. 14-17, one end of the greeting card 60 contains a drawing of a beer and the opposite end contains a drawing of a glass of wine. Turning the on/off switch 64 to the "on" position with the drawing of the beer appearing at the top of the greeting card 60 initiates playback of a first audio clip which is a recording of a man's voice saying something with regard to beer. Flipping or rotating the card 60 in a clockwise or counterclockwise direction, with the drawing of the wine glass appearing at the top of the greeting card 60, initiates a second audio clip which is a recording of a woman's voice saying something with regard to wine. Thereafter, each time the greeting card 60 is flipped or turned to the opposite side, an audio clip is replayed interchanging between the male and female voices. Different audio clips are used each time until all of the audio clips have been played back in sequence. Once the end of the sequence is reached, such as for example, after 11 turns (replaying a total of 12 different audio clips in sequence) of the greeting card, the playback sequence begins again with the first audio clip.

While the above embodiment has been described as having an on/off switch and a ball sensor, other switches and/or sensors have been contemplated and are considered to be within the scope of the present invention. Any number of audio files may be stored in memory containing any number of different messages, songs, sounds or any other recordable audio. The audio may be replayed upon moving the on/off switch from "on" to "off" and also upon moving the card or the audio may only be replayed upon moving the greeting card. The movement of the greeting card which triggers the audio playback is referred to herein as movement in a clockwise or counterclockwise direction, which is useful when used in combination with a ball sensor or tilt switch, as described above. However, as indicated above, any other type of motion sensor may be used with this embodiment and so therefore, any type of movement may be used to trigger the audio playback. The greeting card may also contain a USB port, SD card slot or any other external memory device port for uploading user-selected audio files. Additionally, the greeting card may contain a recording device and switch for initiating a recording session and saving said user-recording within memory.

The three-dimensional foam greeting cards of the present invention may also contain a battery-saving device which includes a small substantially rectangular plastic insert which is inserted into a small slot in the foam body. The slot is located directly outside the location of a battery circuit switch which is contained on the circuit board inside the foam body. When the device is inserted into the slot the circuit is opened, preventing batteries from draining while the product is not in use. When the device is removed, the circuit closes, and the batteries are activated, allowing the user to record a message, play an audio clip, light up the greeting card or cause components of the greeting card to be put in motion.

It should be noted that the three-dimensional foam greeting card described herein may contain one or a combination of two or more functions, as described, such as sound, light, audio, recording, motion, or multimedia functions. Additionally, a variety of switches are mentioned herein and can be used alone or in combination and may be located in a variety of locations on the three-dimensional foam greeting card.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Other features and aspects of this invention will be appreciated by those skilled in the art upon reading and comprehending this disclosure. Such features, aspects, and expected variations and modifications of the reported results and examples are clearly within the scope of the invention where the invention is limited solely by the scope of the following claims.

What is claimed is:

1. A greeting card comprising:

a greeting card body;

an electronics module operative to store and playback a plurality of audio clips;

a first switch which is an on/off switch operative to control power to the electronics module;

a second switch which controls playback of the plurality of audio clips;

wherein the second switch will not initiate playback of one of the plurality of audio clips until the greeting card body is rotated at least 180-degrees;

wherein playback of each of the plurality of audio clips is pre-programmed such that each audio clip is different from the audio clip which is played either before it or after it in a sequence.

2. The greeting card of claim 1, wherein the first switch is accessed through the perimeter surface of the greeting card body.

3. The greeting card of claim 1, wherein the second switch cannot be activated until the first switch is in the "on" position.

4. The foam greeting card of claim 1, wherein a first audio file is replayed upon turning the first switch to the "on" position.

5. The greeting card of claim 4, wherein playback of the first audio file instructs the user how to initiate additional audio clips.

6. The greeting card of claim 1, wherein the plurality of audio files are played back according to a specific sequence.

7. The greeting card of claim 1, wherein once each of the plurality of audio files have been played back once in sequence, the sequence is repeated.

8. A foam greeting card comprising:

a single foam body having a cavity contained therein;

an electronics module contained and concealed within the cavity, the electronics module operative to store and playback a plurality of audio files;

an on/off switch;

a tilt switch which initiates playback of one of the plurality of audio files only when the single foam body is flipped upside down while the on/off switch is set to the "on" position.

9. The foam greeting card of claim 8, wherein the plurality of audio files are played back in a specific sequence.

10. The foam greeting card of claim 9, wherein once the specific sequence has been played back, the sequence is repeated.

11. The foam greeting card of claim 8, wherein the electronics module contains at least three different audio files.

12. The foam greeting card of claim 8, wherein a first audio file is played upon moving the on/off switch to an "on" position.

13. The foam greeting card of claim 8, wherein the audio files each contain a spoken message.

14. The foam greeting card of claim 13, wherein the spoken messages interchange between a male and female voice upon each turn of the single foam body.

15. A foam greeting card comprising:

a foam body;

an electronics module operative to store and playback a plurality of different audio clips in a pre-determined playback sequence;

a switch which only triggers playback of one of the plurality of digital audio files upon a user turning the foam body 180-degrees; and wherein each time the entire sequence of audio clips has been replayed, the sequence is repeated and wherein each audio clip in the sequence is different from every other audio clip in the sequence.

16. The foam greeting card of claim 15, wherein instructions for initiating playback of the plurality of digital audio clips is printed on a front planar sheet material which is attached to a front surface of the foam body.

17. The foam greeting card of claim 16, wherein a back planar sheet material is attached a back surface of the foam body and also to a second planar sheet material along a fold line.

18. The foam greeting card of claim 17, wherein a first drawing appears at the top of the front planar sheet material and a second drawing appears upside down and opposite the first drawing at the bottom of the front planar sheet material.

19. The foam greeting card of claim 18, wherein each of the plurality of audio clips alternate between a male and a female voice.

* * * * *